US005122192A

United States Patent [19]

Inukai et al.

[11] Patent Number: 5,122,192

[45] Date of Patent: Jun. 16, 1992

[54] METHOD AND APPARATUS FOR CLEANING ELECTROSTATIC COATING HEAD

[75] Inventors: Yuzo Inukai; Kenji Tashiro; Hideyuki Kafuku, all of Shizuoka, Japan

[73] Assignee: Fuji Photo Film Co., Ltd., Kanagawa, Japan

[21] Appl. No.: 423,307

[22] Filed: Oct. 18, 1989

[30] Foreign Application Priority Data

Oct. 25, 1988 [JP] Japan ..... 63-267089
Jan. 18, 1989 [JP] Japan ..... 1-7774

[51] Int. Cl.[5] ..... B08B 5/02

[52] U.S. Cl. ..... 134/37; 134/1; 134/34; 134/42; 118/629; 427/185

[58] Field of Search ..... 134/37, 21, 22.12, 22.15, 134/34, 42

[56] References Cited

U.S. PATENT DOCUMENTS 2,789,927 4/1957 Olson ..... 134/37
3,410,070 12/1968 Denis ..... 134/37
4,026,701 5/1977 Till et al. ..... 134/21

FOREIGN PATENT DOCUMENTS 0224052 6/1987 European Pat. Off. .
5-47161 4/1980 Japan .
57-24660 2/1982 Japan .
57-24661 2/1982 Japan .
57-24672 2/1982 Japan .
57-24673 2/1982 Japan .

*Primary Examiner*—Anthony McFarlane
*Attorney, Agent, or Firm*—Sughrue, Mion, Zinn, Macpeak & Seas

[57] ABSTRACT

An electrostatic coating (atomizing) head is cleaned by ejecting an ejected steam stream to the electrostatic coating head to remove solidified mass of a coating solution deposited thereon.

Ejecting is made via steam stream supply ports to forward and rear surfaces of the coating head without interrupting high voltage applied for coating or even during the coating operation. The method is suitable for aqueous coating solution.

16 Claims, 5 Drawing Sheets

METHOD AND APPARATUS FOR CLEANING ELECTROSTATIC COATING HEAD

FIELD OF THE INVENTION

This invention relates to a method and an apparatus for cleaning an electrostatic spray or coating head (generally referred to as "coating head") for an electrostatic coating device, such as an electrostatic coating device having a cup-shaped rotary atomizing head and adapted for electrostatically atomizing a coating solution by a rotary discharging rim of the atomizing head for applying the coating solution to an article to be coated. More particularly, it relates to a method for safely and efficiently cleaning an atomizing head of an electrostatic coating device employing a water-base paint (referred to as "aqueous paint" hereinafter), without interrupting the application of a high voltage to the atomizing head.

BACKGROUND, PRIOR ART AND PROBLEMS TO BE SOLVED

In a coating operation, a solvent-type coating agent or paint, consuming a larger quantity of an organic solvent, allows a larger amount of the solvent to be dissipated to atmosphere to give rise to atmospheric pollution or worsening of the working environment. Thus the use of the aqueous paint is considered and, above all, the application of the aqueous paint to electrostatic coating is implemented.

With continued use of the electrostatic coating device, a solidified mass, either dried or semi-dried, of the coating solution is formed on an electrostatic spray head, such as a nozzle, bell, spray gun or disk, atomizing the coating solution, above all of an aqueous type, and grows in size. The solid mass that has grown in size obstructs atomization of the coating solution to produce unevenness in the coating film or becomes affixed to the article to deteriorate the appearance and quality of the coating film. Thus the conventional practice has been to supply cold or warm water or other liquids to the coating head directly to dissolve the solid mass before it grows in size to deteriorate the appearance of the coating film. In the JP U.M. Kokoku Publication No. 62-31174 (1987), there is proposed a spray coating device in which cold or warm water is caused to flow on a liquid film forming plate disposed in the vicinity of the article to be coated to prevent the growth of the solid mass.

However, when cold or warm water for dissolving the solid mass is supplied directly to the electrostatic coating head, it is necessary to cut off the high voltage source for applying a high voltage to the coating head to prevent short-circuiting. Moreover, a large quantity of water is required for cleaning with cold or warm water resulting in that much time is involved in cleaning the coating head.

In addition, safety problems may be presented when the operator forgets cutting off the high voltage source when cleaning the spray head.

The problems inherent in the electrostatic spray device provided with a cup-shaped rotary atomizing head as the electrostatic spray head and the measures taken in the prior art to cope with these problems, are discussed hereinbelow.

In the electrostatic coating device, having the cup-shaped (or so-called mini-bell type) rotary atomizing head, the paint supplied from a paint supply nozzle to a paint receiving portion is in the form of a thin film, under the centrifugal force produced by rotation of the cup-shaped rotary atomizing head, and is discharged and atomized by the rotary discharge rim. However, the following problem may be presented when the electrostatic coating method is used to atomize the aqueous paint which is rich in volatile solvents and in which the boiling point is difficult to control.

When the rotary atomizing head is rotated at a speed of about 4000 r.p.m. or higher, a reduced pressure is created in the inner space of the atomizing head to produce an air pumping phenomenon, that is, a phenomenon in which air is driven into the inside of the atomizing head. A part of liquid droplets of the comminuted aqueous paint discharged from the rotary discharge rim is entrained in the air driven into the inner space of the atomizing head to become affixed to the inner peripheral surface of the atomizing head. At the partial place where the this film of the aqueous paint has not been formed on the inner peripheral surface, the moisture in the deposited liquid droplets is vaporized and the liquid droplets are dried or semi-dried to become affixed to the atomizer head in the form of precipitates of the solid component. When the aqueous paint is continuously atomized for a prolonged period of time in this state, the solid components continue to be precipitated and accumulated to grow in size in the normal line direction until they come to obstruct the flow of the water base paint in the from of a thin film. If atomization is continued further, liquid droplets become affixed to the discharge rim of the inner peripheral surface where the flow is obstructed to form precipitates of solid components which then are allowed to grow towards and as far as the discharge rim. Thus the aqueous paint cannot be formed into a uniform thin film while it is guided as the thin film towards the discharge rim. Thus, when the atomizing head is used in a coating device, the atomized aqueous paint has a larger particle size to lower the coating performance. When the head is used in a coating device employing a pneumatic motor, the number of revolutions of the atomizing head is lowered on account of the precipitates solid components to give rise to similar inconveniences.

In addition, a part of the liquid droplets of the comminuted aqueous paint discharged from the rotary discharge rim is affixed in a larger amount on the reverse side of the discharge rim of the atomizing head to cause solid components to become precipitated to grow in size in the normal line direction or occasionally to become affixed on the article to be painted to deteriorate the coating quality or performance.

For overcoming the above mentioned drawbacks, there are disclosed in the JP Patent Kokai Publications Nos. 57-24660, 57-24661, 57-24672, 57-24673 and 57-24674 (all of 1982) an electrostatic coating apparatus in which, when electrostatically atomizing the water base paint at the rotary discharge rim for electrostatic coating, water, lukewarm water, water-soluble solvents, solvents or a mixture of water and a solvent, is supplied to the cup-shaped rotary atomizing head to effect cleaning of the rotary cup.

In the JP Patent Kokai Publication No. 54-154436 (1979), there is disclosed a cleaning method and a cleaning device in which automatic grounding is effected by a grounding device at the same time that the voltage applied to a rotary cup is interrupted during cleaning of the rotary cup, wherein the charges on the cup are allowed to discharge without sparking.

Various methods and devices for cleaning the cup-shaped rotary atomizing head are also known such as by the JP UM Kokai Publications Nos. 61-106360, 61-106361 and 61-106362 (all of 1986).

However, these methods are inconvenient in that the high electrical voltage applied to the rotary cup has to be interrupted once during the coating operation to protract the total cleaning time, and in that, in case of continuous coating or coating on a continuously running article, the output per unit time may be lowered due to increase in insufficiently cleaned articles.

SUMMARY OF THE DISCLOSURE

In view of the foregoing, it is a principal object of the present invention to provide a method and an apparatus for cleaning an electrostatic coating head which is free from the above mentioned drawbacks of the prior art.

It is a more specific object of the present invention to provide a method and an apparatus for cleaning an electrostatic coating head such as an atomizing head whereby the cleaning time may be shortened and the number of insufficiently cleaned articles may be reduced.

In accordance with the present invention, there is provided a method for cleaning an electrostatic coating head of an electrostatic coating device comprising supplying an ejected steam stream to the electrostatic coating head to remove the solidified mass of a coating solution deposited on the electrostatic coating head. The ejected steam stream may be supplied by ejecting a pressurized steam from a supply port.

According to the present invention, there is also provided a cleaning device for an electrostatic coating head of an electrostatic coating device, said cleaning device comprising a steam stream supply port for supplying an ejected steam stream to the electrostatic coating head. The upstream of the supply port is formed of an electrically insulating or insulated conduit.

The ejected steam stream is referred to as "steam jet stream" herein for description.

The jet stream of a pressurized steam supplied to the solidified mass of the coating solution, above all, the aqueous coating solution, affixed to the electrostatic coating head of the electrostatic coating device, has a breakdown voltage exceeding the voltage applied to the coating head, so that no current flows through the steam jet stream when the voltage is applied to the coating head. The steam jet stream may be at a higher temperature than the solidified mass of the coating solution, above all, the aqueous coating solution, so that, when the steam jet stream is supplied to the solidified mass of the coating solution having a lower temperature than the steam stream, the steam jet is condensed and liquefied. The liquid thus produced may sink into the solidified mass which is thereby wetted and brought to the liquid state in which it may be removed more easily from the coating head so that it may be removed by the ejection energy of the steam jet.

According to the method and the apparatus of the present invention for cleaning the electrostatic coating head, cleaning of the electrostatic coating head, that is, removal of the solidified mass of the solid components of the atomized liquid droplets affixed as precipitates and accumulated on the atomizing head, may be performed without short circuiting, thus without the necessity of disconnecting the high voltatage source to be applied to the electrostatic coating head of the electrostatic coating device, so that cleaning may be terminated in a shorter time. Since the high voltage source need not be disconnected, the necessity for high-voltage re-establishing the high voltage by turning a dial or voltage stabilization operation may be eliminated and the coating head may be cleaned safely in a shorter time with the high voltage source remaining connected in circuit. Above all, an elongated continuously travelling band-like material may be coated in accordance with the present invention without causing waste losses, i.e., insufficiently coated articles. In this manner, the operating efficiency of the electrostatic coating device may be improved. The cleaning appratus of the present invention may be automated easily to contribute to the operational safety.

The ejection pressure of the vapor jet is preferably 0.1 to 10 kgf/cm$^2$ (gauge pressure).

Preferably, the piping portion contacting with the steam flow upstream of the steam jet supply port is formed of an electrically insulating material. There are also provided two or more steam jet supply ports for separately supplying pressurized steam jets to the front or end face and to the back surface of the coating head and means for moving the steam jet supply ports.

The electrostatic coating device is preferably so constructed and designed that the paint is supplied to the cup-shaped rotary atomizing head provided to the foremost part of a rotary shaft that may be rotated at an elevanted speed, a thin paint film is formed on the inner peripheral surface of the atomizing head under the centrifugal force produced by the rotating atomizing head, and a high voltage is applied to the atomizing head to cause the paint in the form of the thin film to be centrifugally ejected as mist from the rotary discharge rim of the atomizing head so as to be deposited on the article. Pressurized steam is sprayed onto the solid components (deposited solid mass) for removing these components. Preferably, air at a low humidity is supplied into a conduit adapted for transporting the pressurized steam to complete the cleaning of the atomizing head.

Figure 1:
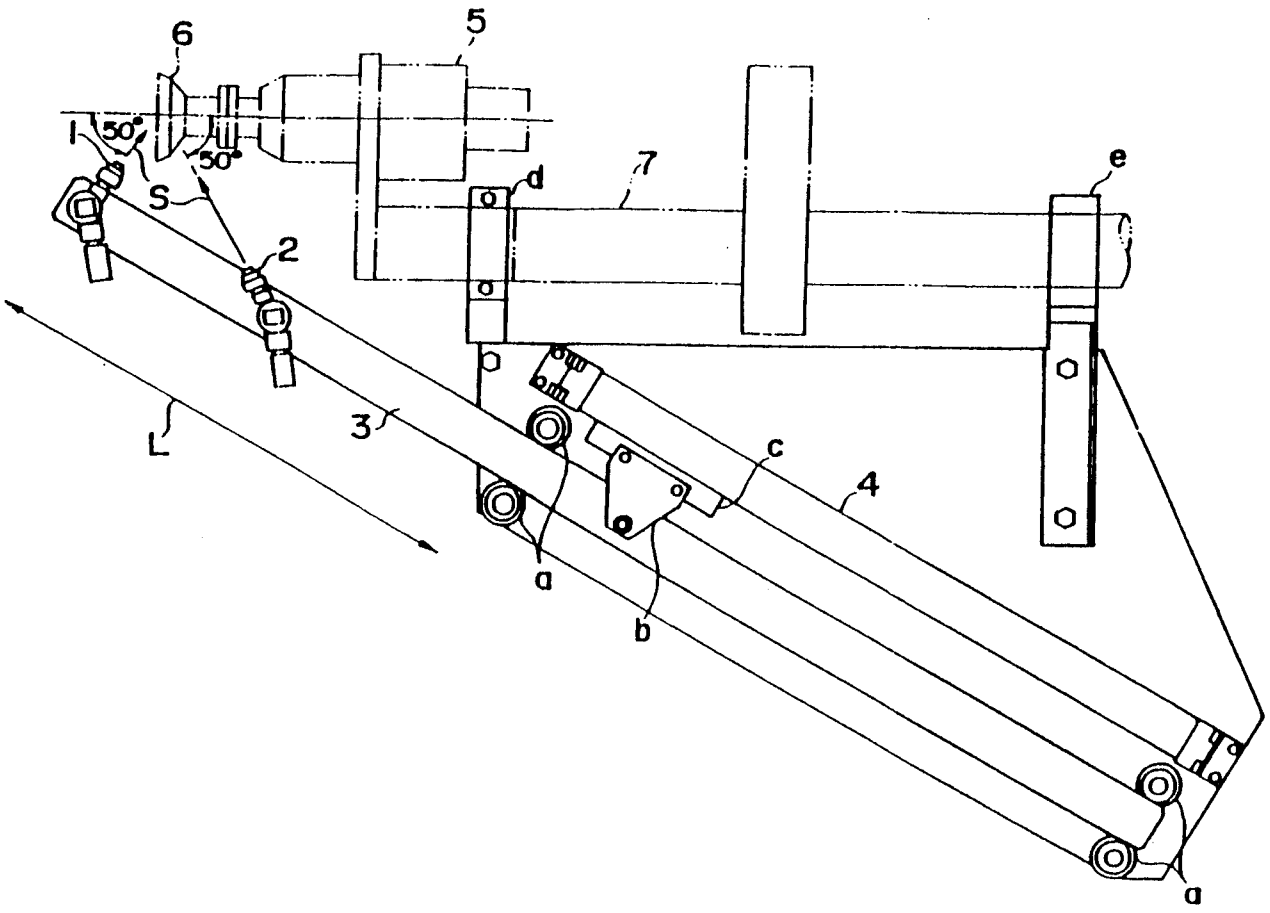
FIG. 1 is a diagrammatic view showing an embodiment of a cleaning device of the present invention.

The general construction of a cup-shaped rotary atomizing head provided to an electrostatic coating device, and the problem of deposition of comminuted liquid droplets on the atomizing head and of precipitation of solid contents, which is presented when the aqueous paint is turned into the comminuted droplets and emitted from a rotary discharge rim (or edge) so as to be applied to an article, is now explained with reference to FIG. 3.

Referring to this figure, a main body of the atomizing head 41 has a conical inner peripheral surface 42, and end rim 43 of which is opened toroidally. The main body of the atomizing head 41 is also termed a bell rim.

In the inside of the main body of the atomizing head 41 is secured a reservoir for a liquid to be sprayed, or a bell hub 44, formed by a tubular member with an end part 45 having a toroidal opening 44'.

The main body of the atomizing head 41 is kept in contact with the bell hub 44 via an embedded O-ring, not shown. The back surface of the bell hub 44 is provided with several screws, not shown, for securing the main body of the atomizing head 41 to the bell hub 44 with the centerlines of the main body of the atomizing head 41 and the bell hub 44 center-aligning with each other. The end part 45 of the bell hub 44 is supported by supporting studs 46 and partially formed by a securing bolt 47. The securing bolt 47 secures a rotational shaft 48 and the bell hub 44 on their central axes.

Between an inner peripheral surface 49 and the end part 45 of the bell hub 44, there is formed an annular slit 46', which is supported by the supporting studs 46.

The atomizing head 41 is driven into rotation by the rotational shaft 48, so that, when a paint is supplied to the inner peripheral surface 49 of the bell hub 44 by a paint supply nozzle 50, a thin paint film is formed along the inner peripheral surface 49 under the centrifugal force produced by the rotation of the main body of the atomizing head 41. This thin paint film flows out via the annular slit 46' to reach the conical inner peripheral surface 42 of the main body of the atomizing head 41. The paint film proceeds further in the form of a film of reduced thickness until it is atomized and discharged at the end rim 43, also termed a rotating discharge rim.

Due to high-speed rotation of the main body of the atomizing head 41, the space within the atomizing head is evacuated to produce a phenomenon in which air is inspired into the inside of the atomizing head, that is, a phenomenon known as air pumping. As a result of such air pumping, some of the droplets of the atomized aqueous paint from the end rim 43 are entrained and returned so as to be continuously deposited and accumulated on the surface of the end part 45 of the bell hub 44. These droplets of the atomized aqueous paint are dried as they grow in size along the normal line direction with the high-speed rotation of the atomizing head, while the solid component is precipitated. The accumulated mass of the solid content may offer an overload to the rotating atomizing head to cause the number of revolutions of the atomizing head to be lowered to adversely affect the atomizing and coating performance. Also, part of the accumulated mass may be stripped and deposited on the article to similarly adversely affect the coating performance.

If the accumulated mass of the solid component is allowed to grow further in size, the flow of the aqueous paint flowing as a thin film out of the annular slit may occasionally be impeded to cause liquid droplets to be deposited on the conical inner peripheral surface. The liquid droplets thus deposited on this peripheral surface behave in the similar manner to adversely affect the coating performance.

For controlling the flight range of the fine droplets (mist), there is known a method, sometimes called shaping, consisting in flowing pressurized air in a cone surface-like fashion (i.e., in a toroidal or annular pattern in the cross section) and confining the discharged droplets in the pressurized air. However, depending on the flowing manner or amount of the pressurized air, fine liquid droplets are again deposited on the reverse side of the end rim 43 to cause precipitation of solid components. In this case, the accumulated mass of the liquid droplets grow in size in the normal line direction and are partially stripped off to adversely affect the coating performance.

As a result of our eager researches into finding a method for safe and efficient removal of the accumulated mass of the solid components on the atomizing head, the present inventors have arrived at the method wherein the atomizing head is cleaned by spraying steam thereto under pressure and, in case the steam is supplied under pressure by way of a conduit, the low-humidity air is preferably supplied by way of the same conduit. This finding has led to completion of the present invention.

The most outstanding feature of the present invention is that, in the above mentioned cleaning process, the accumulated mass may be removed without interrupting the supply of the high voltage to the atomizing head.

DETAILED DESCRIPTION OF THE PREFERRED EMBODIMENTS

The ejection pressure of the steam stream need be only sufficient to effect ejection and cleaning under heating and humidifying. The steam pressure of not less than 0.1 $kgf/cm^2$ in gauge pressure (i.e., a slight overpressure exceeding the atmospheric pressure) suffices as long as the effect of steam ejection is concerned. While there is no upper limit to the ejection pressure, it may be of the order of 10 $kgf/cm^2$ or less for practical purposes.

The temperature of the ejected steam stream need only be sufficient to permit the solid deposits of the coating solution to be dissolved or peeled off easily. Thus it is usually not lower than 100° C. However, it may preferably be 110° C. or 120° C. or higher.

Saturated steam may usually be employed as the jet steam stream. However, after exiting the port, a supersaturated steam stream or a saturated steam stream containing a certain amount of water (namely wet steam) may also be employed as the steam jet stream. In the cleaning apparatus of the present invention, it is only sufficient that at least the piping upstream of the steam jet supply port has electrically insulating properties.

Although air is usually entrained into the above mentioned steam jet, gases may also be mixed compulsorily into the steam jet.

The steam jet supply port in the cleaning apparatus may be formed as a nozzle. As the electrically insulating material for the piping section from the steam jet stream supply port in the upstream side contacting with the steam stream, any material having predetermined values of electrical insulating and thermal resistance, may be employed. Examples of these materials include electrically insulating resins, such as polyester, polyethylene, polypropylene, ethylene polyfluoride type resins, (Teflon, trade name), butyl rubber, silicon rubber, fluorine rubber or ethylene-propylene rubber, and electrically insulating ceramics, such as alumina, forsterite, beryllia or mullite.

The cleaning method and apparatus of the present invention may be applied to an electrostatic coating head provided in an electrostatic coating device for atomizing the coating solution, above all, the aqueous coating solution, such as, for example, bells or cones (e.g., rotary bell) spray nozzles, guns or disks.

Referring to the drawings, a preferred embodiment of the present invention will be explained in more detail.

Embodiment 1

Figure 3:
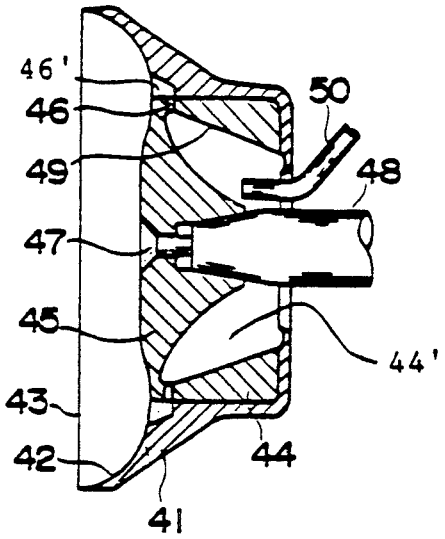
FIG. 3 is a sectional view showing the atomizing head of an electrostatic coating device along the direction of the rotational axis of the head.

FIG. 1 shows diagrammatically a cup-shaped rotary atomizing head 6, which is an electrostatic coating (spray) head of an electrostatic coating device, and the cross-section of which along the direction of its rotational axis is shown in FIG. 3, and the neighboring portion, indicated by double-dotted chain lines, with an embodiment of a cleaning device of the present invention, indicated by solid lines.

Steam jet nozzles 1 and 2, functioning as the steam jet stream supply ports, are provided at one end of a generally rectangular steam jet nozzle assembly 3 towards the atomizing head 6. These nozzles 1 and 2 are provided each with ball-and-socket joints so that the jet ports of the steam jet nozzles 1 and 2 may be oriented for supplying the steam jet S in any desired direction.

The nozzle assembly 3 is connected via a connector b to a moving member C connected in turn to a linear actuator (e.g., a piston of a cylindrical rodless pneumatic cylinder 4). The moving member C is projected out of the cylinder 4 by way of a slit, not shown, which is at least 400 mm long and which is formed in the side wall of the cylinder 4 parallel to the piston moving direction, so as to be reciprocated along the slit length. Thus the nozzle assembly 3 may be reciprocated in the direction indicated by the arrow L in FIG. 1 with a stroke of, for example, 400 mm. Thus the cleaning device of the present invention may be provided as one with an electrostatic coating device, as described hereinbelow, without obstructing the electrostatic coating operation. The nozzle assembly 3 may be guided in its reciprocating movement positively and accurately by generally cylindrical guide rollers a supported by pivot shafts, not shown.

During cleaning of the atomizing head 6, the stroke of the nozzle assembly and the jet ports of the steam jet nozzles 1 and 2 are adjusted so that the center ejection axis of the steam jet nozzle 1 intersects the center coating solution ejection axis of the atomizing head 6 at an angle assuring satisfactory cleaning, such as 50°, and so that the steam jet from the steam jet nozzle 2 is directed towards the rear surface of the atomizing head 6.

The vapor jet nozzles 1 and 2 operate to supply a saturated vapor stream at a pressure of 0.1 to 10 $kgf/cm^2$ (gauge pressure) to a solidified mass of the aqueous coating solution deposited on the mini-bell type atomizing head 6 to liquefy the solid mass and cause it to flow down or fly away for removal. The jet nozzles 1 and 2 then supply air to the atomizing head 6 by way of a three-way steam/air changeover valve as later described to dry and cool the inside of the atomizing head 6 and the insulating piping.

The above described cleaning device is suspended from securing members d and e provided in tight contact with the surface of a cylindrical section 7 adapted for moving the atomizing head 6 of the electrostatic spraying device in the fore and aft direction, and is thereby secured in position. A generally cylindrical bell-rotating motor 5 has enclosed therein a liquid supply pipe and causes the rotation of a rotary shaft of the atomizing head 6.

The atomizing head 6 may be cleaned in its operating position of spraying the coating solution onto the article to be coated. However, the atomizing head may also be cleaned after it has been separated away from the article so as not to affect the article.

The piping for the steam jet nozzles 1 and 2 and the driving piping for the rodless pneumatic cylinder 4 are formed of an electrically insulating ethylene polyfluoride resin (Teflon, trade name).

Figure 2:
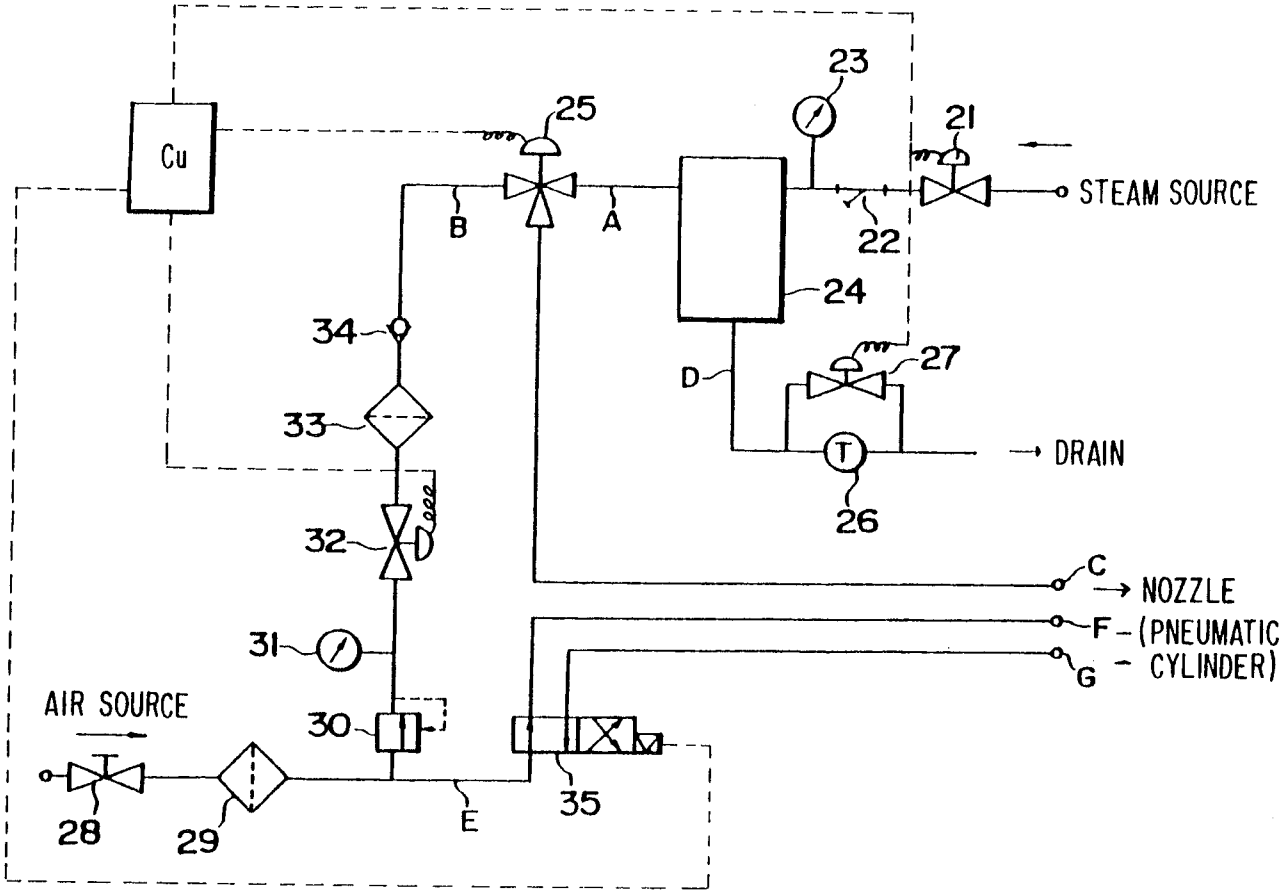
FIG. 2 is a vapor/air piping flow diagram for the cleaning device shown in FIG. 1.

FIG. 2 shows the arrangement of the vapor piping and the air piping connecting to the steam jet nozzles 1 and 2 and the rodless pneumatic cylinder 4. A piping A, provided with a valve 21, a steam strainer 22, a pressure gauge 23 and a pressure storage box 24 in tandem in this order from the upstream steam source side, is connected to a steam/air changeover three-way valve or L port 25. The piping A is used for transferring the steam from the steam source. To the pressure storage box 24 is connected an outdoor drain piping D provided with a parallel connection of a steam trap 26 and a drain flow-off valve 27.

A piping B, provided with a valve 28, a filter 29, a pressure-reducing valve 30, a pressure gauge 31, an air on/off two-way valve 32, a Reman dry filter 33 and a steam back flow preventing check valve 34 in tandem in this order from the upstream air source side, is connected to a steam/air changeover three-way valve 25. The piping B is used for transferring the air from the air source.

By switching the steam/air changeover three-way valve 25, the cleaning steam or the drying air may be supplied to the piping C connected to the steam jet nozzles 1 and 2. After termination of cleaning, drying and dehumidifying gas (e.g., air) is preferably passed through the piping C and further downstream portions so as not to allow the drain to be accumulated in the piping C and the inside of the steam jet nozzles 1 and 2. Thus the remaining drain in the piping C can be purged. The valves 25, 27, 32 and 35 may be controled by a control unit (CU) which allows both manual and/or programmed control.

A portion of the air flow from the air source flows into a piping E branched from the piping B downstream of the filter 29. The piping F and G connect to the rodless pneumatic cylinder 4, while the piping E connects to a two-position four-way control valve 35. Thus, by switching the control valve 35, the air in the piping E is supplied via piping F or G to the pneumatic cylinder 4 for driving the cylinder 4. The air used for driving the cylinder is then discharged via piping F or G.

Embodiment 2

Figure 4:
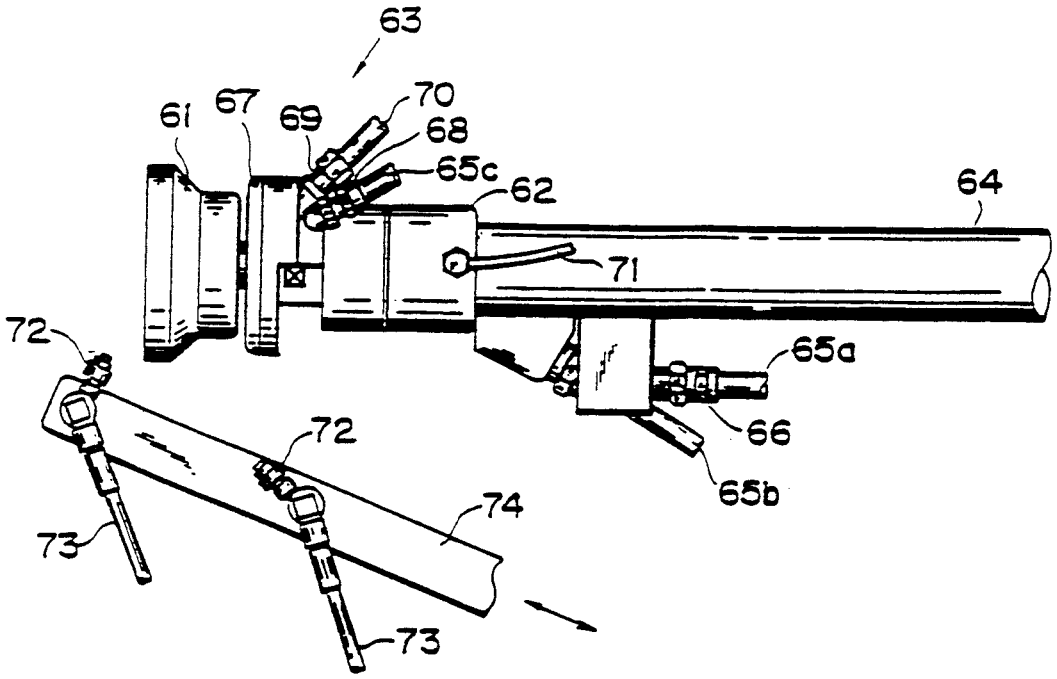
FIG. 4 is a diagrammatic view showing an embodiment of a cleaning device according to the present invention and the vicinity of the coating (atomizing) head of the electrostatic coating device.

FIG. 4 shows diagrammatically an electrostatic coating device provided with the above described atomizing head as the aforementioned atomizing head, the cross-section of which along the direction of the rotational axis is shown in FIG. 3, and a preferred arrangement of a cleaning device for practicing the cleaning method of the present invention.

A cup-shaped rotary atomizing head 61 of a metallic material, such as aluminum, is made up of a main body 41 and a bell hub 44, as shown in FIG. 3, and is provided at the end of an rotary (output) shaft 48 of a pneumatic motor 62. A spray head section 63, comprised of the pneumatic motor 62 fitted with the atomizing head 61, is stationarily positioned by a supporting member 64. The pneumatic motor 62 is driven into revolutions by pressurized air from a pressurized air generator, not shown, supplied to an inlet port 66 of the motor 62 via an air hose 65*a*, with the air being discharged via another air hose 65*b*. The pneumatic motor 62 is provided with a annular flow-out port 67 and an air supply port 68 for shaping, while being also provided with a paint supply nozzle 69 for supplying the paint to the atomizing head 61.

The paint is supplied to the nozzle 69 from a paint supply unit, not shown, via a paint hose 70, so as to be transported to the atomizing head 61. A high electrical voltage is applied to the pneumatic motor 62 via high voltage cable 71 from a high voltage generator, not shown, so as to be supplied via the output shaft 48 of the motor 62 to the atomizing head 61. For preventing current leakage from the atomizing head section 63, the air hoses 65*a*, 65*c*, paint hose 70 and the supporting member 64 are formed of an electrically insulating material, such as polypropylene, polyvinyl chloride, polyacetal, polyethylene or polytetrafluoroethylene. If the supporting member 64 cannot be formed of an electrically insulating material, a support rack or pedestal, not shown, for the supporting member 64 may be formed of an insulating material and a space may be conserved for electrical insulation around the supporting member 64. As a matter of course, a similar space for electrical insulation needs to be provided around the atomizing head section 63.

When the aqueous paint is supplied in this manner to the atomizing head section 63 to perform an electrostatic coating operation, solid components in the aqueous paint are precipitated and accumulated on the atomizing head 61, as mentioned hereinabove.

The method of removing the precipitated and accumulated solid components will be now explained. Referring to FIG. 4, the numeral 72 denotes a spray nozzle of a metallic material, such as stainless steel, for spraying pressurized steam, that is, a steam jet stream supply port. To this spray nozzle 72 is connected a hose 73 for transporting pressurized steam and low humidity air. The hose 73 may be formed of an insulating material, such as polyester, polyethylene, polypropylene, polytetrafluoroethylene, polyethylene tetrafluoride, butyl rubber, silicon rubber, fluorine rubber or ethylene propylene rubber. However, since it is the pressurized steam that is transported, polyethylene tetrafluoride, polytetrafluoroethylene or fluorine rubber is preferred in view of thermal resistance. Two such spray nozzles 72 are provided for spraying pressurized steam to the inner peripheral surface of the atomizing head 61 and to the reverse side of the end rim 43 simultaneously and are secured to an arm 74. The spraying directions of the spray nozzles 72 are towards the center of the inner conic surface of the atomizing head 61 and the reverse surface of the end rim 43.

The arm 74 provided with the spray nozzles 72 is actuated by a pneumatic cylinder, not shown, for being advanced during cleaning and for being retracted after termination of cleaning.

When the arm 74 is advanced, the spray nozzle 72 is oriented in the aforementioned direction. On the other hand, when the arm 74 is retracted, the spray nozzle is brought to a position of not affecting the electrostatic coating operation.

It is preferred for the advancing arm 74 to be stopped at the same position at all times since then the orientation of the spray nozzle 72 may be fixed to simplify the overall system.

For removing solid components of the aqueous paint precipitated and accumulated on the atomizing head 61 in the course of the continuous electrostatic coating operation, and re-continuing (restarting) the coating operation, the supply of the aqueous paint is stopped, and the arm 74 is advanced. Pressurized steam is then supplied via hose 73 and ejected by the spray nozzle 72 to remove the solid components. Low humidity air is immediately supplied to the hose 73 to remove the moisture in the hose 73 at the same time that the arm 74 is retracted. Ultimately, the aqueous paint is again supplied to the atomizing head to start the coating. Preferably, the sequence of these operations is performed automatically.

If the supply of the aqueous paint can be continued without particular inconveniences during removal of the solid components, such supply is preferably continued for shortening the operating time. Since no current leakage can occur in the course of this sequence of operations, it is unnecessary to interrupt the application of the high voltage to the spray head section 63. Thus the application of the high voltage can be continued advantageously for further shortening the operating time.

The pressure of the pressurized steam sprayed to the spray head 61 is preferably 0.1 to 4 kgf/cm$^2$ (gauge pressure) and more preferably 0.2 to 2 kgf/cm$^2$ (gauge pressure). If the pressure is too low, the efficiency in removing the solid components is markedly lowered. If the pressure is too high, the corresponding effect cannot be expected, but only the occasional operational danger is increased.

The reason the solid components can be removed on spraying the pressurized steam to the atomizing head 61 on which the solid components have been precipitated and heaped resides possibly in that these solid components are soluble in water by nature and are more soluble in water at a higher temperature produced upon steam condensation and that exfoliation of the components is brought about by the steam sprayed to the atomizing head 61 rotating at an elevated speed, these factors operating synergistically. Thus the method of the present invention may be occasionally applied to removing the solid components of the paint other than the aqueous paint.

On the other hand, the inside of the hose 73 is filled with steam, during the time in which pressurized steam is supplied from the atomizing head section 63, to which the high voltage of about −30 to −120 kV is applied. However, no current leakage occurs from the hose 73, possibly because some distance is maintained between the spray nozzles and the atomizing head 61 maintained at an elevated voltage and hence not only steam but also air as an insulator exists between the ends of the spray nozzles 72 and the atomizing head 61, the arm 74 provided with the spray nozzles 72 is also formed of an insulating material and because pressurized steam has been converted from distilled water having a volume resistivity of about $10^7$ ohm.cm, these factors acting synergistically for maintaining the hose 73 at a voltage lower than the breakdown voltage.

After spraying the pressurized steam from the spray nozzle 72, the air maintained at a lower humidity is immediately supplied to remove the moisture to prevent steam from being condensed on the hose 73. The dew point of the air maintained at a low humidity is preferably 0° C. or lower and more preferably −4° C. or lower. The air is supplied at a pressure of 0.1 to 5 kgf/cm$^2$ (gauge pressure) and preferably at a pressure of 0.3 to 3 kgf/cm$^2$ (gauge pressure).

Figure 5:
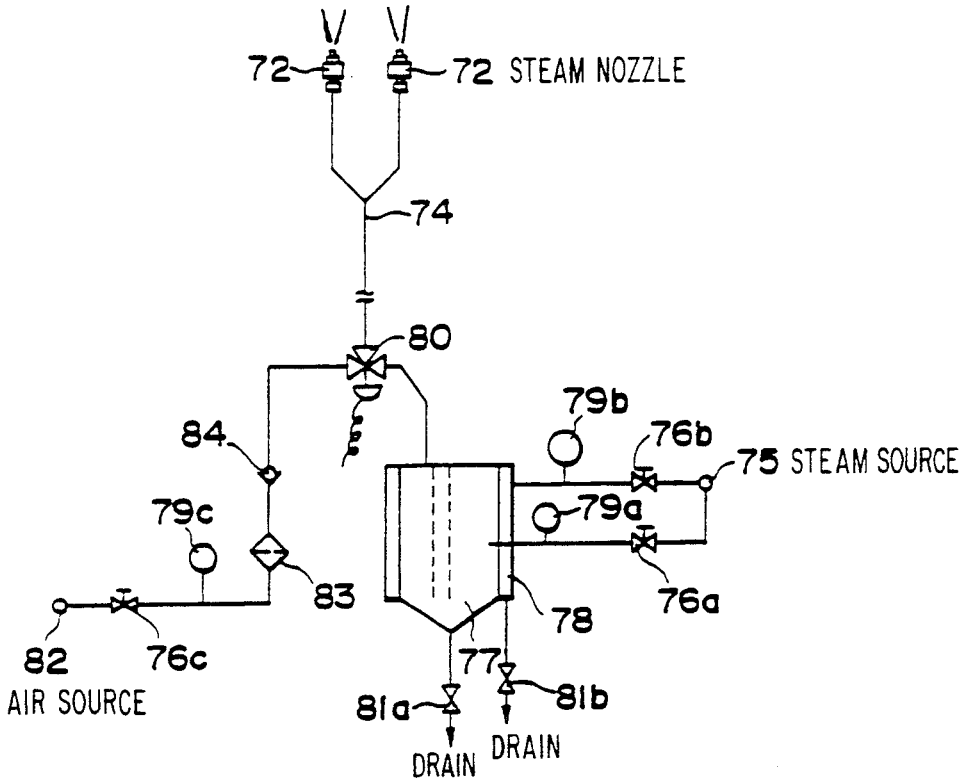
FIG. 5 is a flow diagram of pressurized steam and air at a low humidity for the cleaning device shown in FIG. 4.

The method of switching between the air at the low humidity and the pressurized steam supplied to the spray nozzles 72 is briefly explained referring to the flow diagram of FIG. 5.

The steam supplied under pressure from a steam source 75 is passed through a pressure regulator valve 76*a* to enter a drain eliminator 77. The steam under pressure for keeping the temperature of the drain eliminator 77 is supplied from the steam source 75 via pressure regulator valve 76*a* to enter a jacket 78 to keep the temperature of the drain eliminator 77. The pressure of these separate streams of the pressurized steam is suitably adjusted by the pressure gauges 79*a*, 79*b*. The pressure of the pressurized steam supplied to the jacket 78 is preferably 0.5 to 5 kgf/cm$^2$ (gauge pressure).

The pressurized steam supplied into the drain eliminator 77 is freed of drain thereat so as to be ejected by the spray nozzles 72 by way of the three-way changeover valve 80 and the hose 74.

The drain produced at the drain eliminator 77 and the jacket 78 is discharged out of the system via drain valves 81*a*, 81*b*.

On the other hand, air at a reduced humidity is supplied from a low humidity air source 82 and suitably regulated in its pressure by a pressure regulator valve 76*c* and a pressure gauge 79*c* so as to be transported to a three-way changeover valve 80 by way of a filter 83 and a check valve 84. The steam under pressure or air under low humidity is selected by this three-way changeover valve 80 so as to be supplied to the base 74 and the next following spray nozzles 72. The moisture in the hose may be removed by switching the position of the pressurized steam after termination of the supply of the pressurized steam to supply the air at a lower humidity to the spray nozzles 72.

The cleaning method and apparatus of the present invention will be explained further by referring to Examples. It is to be noted that these Examples are given only by way of illustration and are not intended for limiting the scope of the invention.

EXAMPLES

EXAMPLE 1

Using the cleaning device shown in FIG. 1 (diameter of the steam jet nozzle, 0.05 cm; flow rate, 8.6 kg/hr), cleaning of a cup-shaped rotary atomizing head type or bell type spray head for an aqueous coating solution (diameter: 5 cm; applied voltage: −80 kV) was performed. The steam jet stream for cleaning was saturated vapor at a pressure of 3 kgf/cm$^2$ (gauge pressure) and a temperature of 132° C.

The cleaning operation, which formerly took two to three minutes when the operator performed direct cleaning with water or warm water after cutting off the high voltage power source could be completed in 20 seconds using the above described automatic cleaning device.

The inner surface of the cup-shaped rotary atomizing head immediately after cleaning was observed with a stroboscope. It was revealed that the percipitated and accumulated solid components had been removed completely.

The mean spot size of the atomized liquid droplets after termination of cleaning was not changed from that at the start of coating.

The current leakage during cleaning was also almost unchanged before and after cleaning.

EXAMPLE 2

Electrostatic coating was performed using an electrostatic coating device having an atomizing head as shown in FIGS. 3 and 4, and an aqueous solution of a copolymer of methyl methacrylate-ethyl acrylate-sodium acrylate at a charge weight ratio of 68:20:12 as an aqueous paint at a paint feed rate of 50 ml per minute, an applied voltage to the atomizing head of −90 kV and at a number of revolutions of the atomizing head of 30,000 rpm.

Immediately after starting the coating, the mean spot size of the liquid droplets obtained by atomization was about 30 μm. However, percipitation of the solid components, that is affixture of the paint components on the atomizing head due to drying of the paint deposited on the atomizing head occurred immediately. After about one hour, formation of the thin film of the aqueous paint became difficult on the inner peripheral surface of the atomizing head, while the number of revolutions of the atomizing head was lowered to about 24,000 rpm. The mean spot size of the liquid droplets produced on atomization increased to about 60 μm and spots about 300 μm in size could be found indicating the lowered coating performance. Thus, in accordance with the diagram shown in FIG. 5, the atomizing head was cleaned at a pressurized steam pressure of 0.5 kgf/cm$^2$ (gauge pressure), spraying time of 10 seconds, low humidity air supply time of 10 seconds, drain eliminator temperature maintaining a vapor pressure of 2.0 kgf/cm$^2$ (gauge pressure) and at a distance between the spray nozzles and the atomizing head of about 100 mm.

The supply of the aqueous paint and the application of the high voltage were performed continuously, i.e. without interruptions.

Observation of the inner peripheral surface of the atomizing head immediately after cleaning with a stroboscope revealed that the percipitated and accumulated solid components had been removed completely. The mean spot size of the liquid droplets after termination of cleaning was about 30 μm. The current leakage during cleaning was almost unchanged from that before and after cleaning.

EXAMPLE 3

The coating and the cleaning were performed in the same way as in Example 2 except using the pressure of the pressurized steam of Example 2 of 1.5 kgf/cm$^2$ (gauge pressure). The results similar to those of the Example 2 were obtained.

EXAMPLE 4

The coating and the cleaning were performed in the same way as in Example 2 except using the pressurized steam pressure and the spray time duration of Example 2 of 0.1 kgf/cm$^2$ (gauge pressure) and 20 seconds, respectively. Although some solid components remained heaped on the inner peripheral surface of the atomizing head, the mean spot size of the atomized liquid dioplets after termination of cleaning and the current leakage during cleaning were the same as those to Example 2.

It should be noted that modifications may be made without departing from the concept and gist of the present invention within the scope of the claims hereinbelow appended.

What is claimed is:

1. A method for cleaning an electrostatic coating head of an electrostatic coating device, wherein said electrostatic coating head is employed in atomizing a coating solution for use in coating an article, said method comprising: supplying a jet of steam to the electrostatic coating head to remove solidified mass precipitated from the coating solution and which is deposited on the electrostatic coating head.

2. The method as defined in claim 1, in which said jet stream is supplied intermittently.

3. The method as defined in claim 1, in which said jet stream is supplied by ejecting pressurized steam from a supply port.

4. The method as defined in claim 1, in which said jet stream is supplied without interrupting high voltage applied to the electrostatic coating head.

5. The method as defined in claim 4, in which said jet stream is supplied to a surface of the coating head on which the coating solution flows.

6. The method as defined in claim 5, in which said jet stream is also supplied to a rear surface of the coating head.

7. The method as defined in claim 4, in which said jet stream is supplied while the coating solution flows on the electrostatic coating head.

8. The method as defined in claim 7, in which said jet steam is supplied during continued coating operation.

9. The method as defined in claim 1, in which a low humidity gas having a dew point of 0° C. or lower is supplied with said steam jet.

10. The method as defined in claim 3, in which the pressurized steam has a pressure of at least 0.1 $kgf/cm^2$ higher than atmospheric pressure.

11. The method as defined in claim 3, in which the pressurized steam is saturated steam.

12. The method as defined in claim 3, in which the pressurized steam has a temperature of at least 100 degrees centrigrade.

13. The method as defined in claim 1, in which the jet stream is supplied via an electrically insulating or insulated conduit.

14. The method as defined in claim 1, in which the jet stream is supplied to said coating head while the coating head is rotating.

15. The method as defined in claim 1, in which the coating solution is an aqueous coating solution.

16. The method as defined in claim 3, in which the steam in a conduit connecting to the supply port downstream of a changeover valve is purged by a gas after termination of the jet stream supply.

* * * * *